United States Patent [19]

Anderson et al.

[11] 4,432,707

[45] Feb. 21, 1984

[54] ROLLER ASSEMBLY FOR PERISTALTIC PUMP

[75] Inventors: David S. Anderson; Lawrence F. Kottke, both of Bradenton, Fla.

[73] Assignee: Anko Motors, Inc., Brandenton, Fla.

[21] Appl. No.: 390,386

[22] Filed: Jun. 21, 1982

[51] Int. Cl.[3] ..... F04B 43/12; F04B 45/08

[52] U.S. Cl. ..... 417/477; 417/DIG. 1

[58] Field of Search ..... 417/477, 476, 475, DIG. 1

[56] References Cited

U.S. PATENT DOCUMENTS

| | | | |
|---|---|---|---|
| 3,303,748 | 2/1967 | Duryee et al. | 417/477 |
| 3,723,030 | 3/1973 | Gelfand | 417/477 X |
| 4,233,001 | 11/1980 | Schmid | 417/477 X |

*Primary Examiner*—Richard E. Gluck

*Attorney, Agent, or Firm*—Kinzer, Plyer, Dorn & McEachran

[57] ABSTRACT

An assembly of rollers on pins disposed between and supported by a pair of brackets of sintered, powdered iron keyed to a drive shaft and retained by a spring washer.

4 Claims, 5 Drawing Figures

Fig. 1.
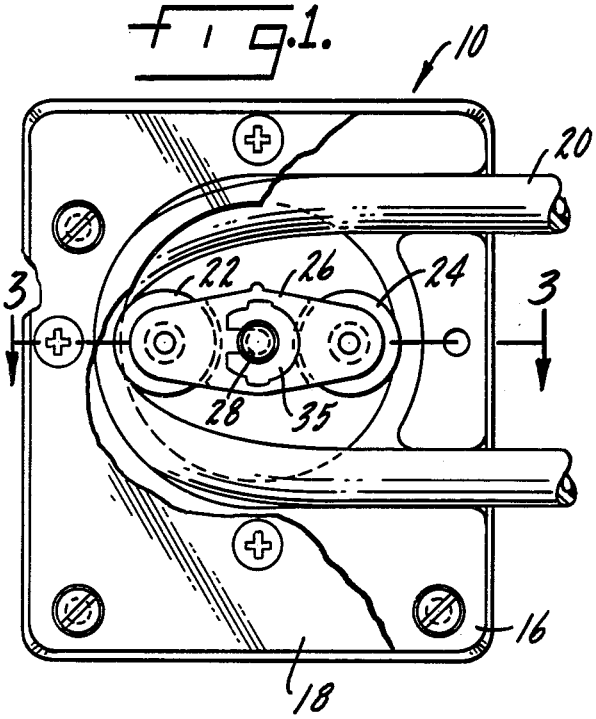
Fig. 2.
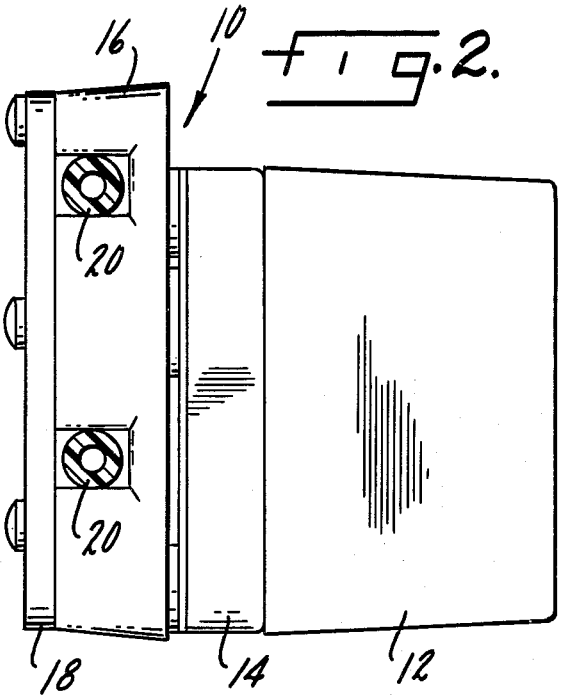
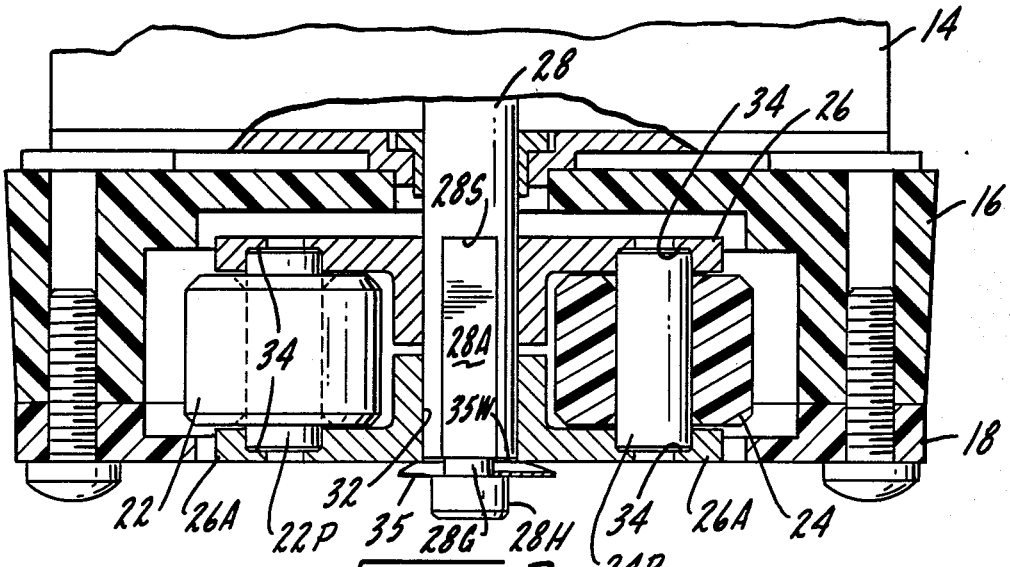
Fig. 3.
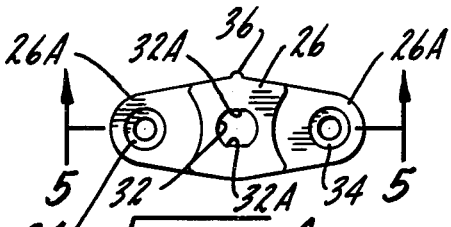
Fig. 4.
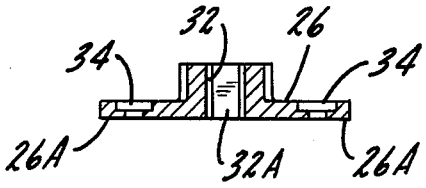
Fig. 5.

ROLLER ASSEMBLY FOR PERISTALTIC PUMP

This invention relates to a roller assembly for a peristaltic pump and the principal object of the present invention is to reduce by a considerable amount the cost of material and labor involved in producing and servicing such assembly.

In particular, we propose to produce and construct parts for the roller assembly so as to require only a screwdriver for servicing, to permit interchangeability of different roller diameters, to avoid dimensional discrepancy in production, to achieve a self-aligning effect for the assembly, to avoid use of a setscrew or a knurl when securing the roller assembly to the motor or pump drive shaft, to be able readily to compensate for wear of the pivot pins, to reduce the parts required for the assembly, to avoid guesswork when locating the roller assembly on the motor drive shaft, to permit the center lines of the rollers to be easily compensated if there is any standard or repetitious discrepancy in production, to enable the roller assembly to be easily adjusted and to so construct the roller assembly it can be shipped preassembled.

IN THE DRAWING

FIG. 1 is an end elevation of a pump, partly broken away, and showing the roller assembly of the present invention;

FIG. 2 is a side elevation of the structure shown in FIG. 1;

FIG. 3 is a sectional view of the pump on the line 3—3 of FIG. 1 but on an enlarged scale showing details of the roller assembly;

FIG. 4 is a detail view of one of the roller assembly brackets;

FIG. 5 is a sectional view on the line 5—5 of FIG. 4.

The pump assembly in which the present invention is identified in FIGS. 1 and 2 by reference character 10, the assembly comprising a motor housing 12, a housing 14 containing reducing gears and a pump housing 16 having a transparent, plastic cover plate 18.

The pump is a peristaltic pump in that a bent flexible tube 20 contains a fluid to be pumped by a set of two or more rollers revolving as a set so that one roller follows the other in timed relation to constrict the tube with a regular intermittence.

This phenomenon is well known and the pump itself may be used for many different purposes, such as dispensing detergents, bleaches, chemical reactants in measured amounts, and so on.

Under and in accordance with the present invention a pair of rollers (there may be more) are yoked or harnessed in a circumferential displacement, these being the rollers 22 and 24 supported for rotation at and between the opposed ends of a pair of brackets 26 which in turn are supported for rotation in unison on a shaft 28 driven by the motor (not shown) inside the housing 12 with the interpositioning of the gears (not shown) inside the gear box 14.

The flexible bent tube 20 and the roller assembly on the shaft 28 are covered, as shown in FIG. 1, by the transparent cover plate 18 which, as will be apparent, is secured by screws to the main pump housing 16.

Experience establishes that when the brackets are supplied as stamped metal parts there can be considerable variance in dimensioning such as to cause discrepancy in the rate or pulsing of the peristaltic pump. To overcome this in accordance with the present invention the brackets 26 are produced as powdered iron parts initially pressed and compacted by a punch and die operation, whereafter the highly densified powdered iron part is sintered to complete a sound metallurgical part. The production is therefore uniform and dependable.

Each bracket includes a plurality of arms 26A, FIGS. 4 and 5, projecting radially from a central aperture 32. The aperture 32 has generally the diameter of the motor driven shaft 28 but to enable the brackets to be keyed to the shaft 28 to be rotated in unison therewith, the apertures 32 are provided with flat surfaces in diametric, opposition, flat surfaces 32A, and these flats match complementally a pair of corresponding flats as 28A, FIG. 3, on the driven shaft 28.

The outboard end of each arm 26A is formed with a shallow pocket 34, FIG. 5, and when the brackets are positioned in opposed relation on the shaft 28, in the fashion shown in FIG. 3, the opposed pockets 34 serve as mounting sockets for the ends of pins 22P and 24P on which the rollers 22 and 24, respectively, are mounted for rotation. By thus providing pockets 34, each having a diameter corresponding to a neat fit for receiving the opposed ends of the support pins 22P and 24P, it is unnecessary to machine the pins with ends of reduced diameter as is the ordinary way for mounting a roller pin in an arm or bracket.

Since the pins are of uniform diameter from one end to the other, this also eliminates any misalignment due to dimensional discrepancy as may be involved when machining a reduced diameter on the pin and this, coupled with the brackets being made of powdered iron, permits the roller assembly to be compensated for any variance in the radial spacing of the pockets measured from the central aperture of the bracket. Thus if there is a slight discrepancy in the center-to-center position of the bracket pockets, this will be repeated uniformly for every powdered iron bracket being released from the press, and if the discrepancy (more than a few thousandths) is one reasonably permissive of compensation, then it is a mere matter of reversing the hand position of the brackets when they are located on the motor shaft 28. This reversing of the hand position is facilitated by producing the brackets with a small protuberance 36, FIG. 4, which may be viewed as identifying the "top" of the bracket as shown in FIG. 4. The bracket to be paired with the bracket shown in FIG. 4 can then be oriented with its identification mark 36 on the "bottom" thereby cancelling a dimensional discrepancy. The protuberance may be located elsewhere and an indentation or nick could be used as well.

The brackets are paired to a pair of rollers as noted above and hence in completing the assembly, the first bracket, the one to be nearer the gear box 14, is located on shaft 28 with its pockets 34 facing in the outer or forward direction. This bracket is pushed on to the shaft 28, with the keying flats in complemental attitude, until the rear surface of this bracket engages and is stopped by the shoulder 28S at the inner end of the flat 28A on shaft 28, FIG. 3. The pins and rollers are physically related and mounted, and then the second bracket is positioned in keyed relation on the front of shaft 28.

More than likely, however, a preassembly of the two brackets and the pair of rollers will be completed before positioning either bracket on the motor shaft 28A and hence it is immaterial which bracket is in leading position when mounting the assembly on the motor shaft. In any event, a pair of pins is selected and their ends are located in the pockets 34 of one of the brackets. The rollers are then located on the pins whereafter the second bracket is juxtaposed with its pockets 34 aligned to the other ends of the pins and moved to a home position. This completes yoking or capturing the two rollers 22 and 24 between a pair of brackets 26 with the ends of the pins 22P and 24P located in the opposed bracket pockets 34. A fixture may be used to aid preassembly.

It can be readily visualized from what is shown in FIGS. 1 and 3 that rollers of different diameter may be easily accommodated while employing brackets and pins of standard dimension, as may be required for tubes 20 of different diameters.

As mentioned above, the first or innermost of the two brackets will be located by the shoulder 28S at the rear of the motor shaft flat. The opposite end of the shaft 28 is provided with a groove 28G, terminated by an enlarged head 28H, and this enables a C-shaped retainer spring washer 35 of appropriate dimension to be spring-fitted into the groove. The spring washer or clip 35 is of concave-convex form so that it provides a strong spring washer 35W at the inner convex side, FIG. 3, exerting a spring-holding force against the area of the outermost (forwardmost) bracket in the area surrounding its motor shaft aperture 32. Thus a spring force is applied to the forwardmost bracket, pressing the assembly tightly against the motor shaft shoulder 28S (there are a pair of such shoulders) and in this manner the roller assembly is effectively located against displacement on the drive shaft 28; at the same time the spring force inherent in the spring clip exerts a rearward thrust on the pins 22P and 24P so that the latter tend to be immobilized between the brackets with the rollers 22 and 24 free to rotate thereon.

It will be seen from the description immediately above that it is unnecessary to employ a screw in holding the roller assembly to the motor shaft 28 for rotation therewith. No tool other than a screwdriver for securing the cover plate 18 in place, and perhaps a pair of pliers for positioning the spring clip 35 is necessary. Also, the shoulder 28S locates the assembly on the shaft without the need for guess-work. At the same time, the roller assembly is self-aligning with slight axial play permissible, compared to using a setscrew actually to lock a roller assembly to the drive shaft; positive driving of the roller assembly does not depend upon a setscrew remaining tight. If there should be any detectable wear on the pins 22P and 24P after sustained or prolonged operation, it is a simple matter to remove the plate 18 and the spring clip 35. When the spring clip 35 is displaced entirely from groove 28G, the thrust it normally applies to the ends of the pins 22P and 24P no longer prevails and upon removing the foremost or front bracket the pins may be turned to a different position to compensate for wear.

It will be seen from the foregoing that the roller assembly of the present invention may be accurately located on the driven shaft without having to estimate the best position nor is a screw employed for this purpose since positioning of the brackets is automatically determined by the dimension of the shoulder 28S serving as a locating stop, while spring cap 35 retains the assembly against displacement. Only one keying flat 32A and stop 28S need by employed, not necessarily two as shown. Any wear on the pins may be easily compensated, as explained above, and by reversing the hand position of the brackets during assembly, a small dimensional discrepancy may likewise be compensated. By having the brackets along with the pins 22P and 24P of standard dimensions, interchangeability of rollers with different diameters is easily effected; also, the bracket assembly floats on the motor shaft and is capable of self-alignment compared to mounting the assembly with a lock or clamp. Different forms of spring retainers may be used.

We claim:

1. A roller assembly to be mounted on the motor driven shaft of a peristaltic pump, the pump having a bent flexible tube containing a fluid to be pumped by revolving rollers which constrict the tube with a regular intermittence, comprising:

a pair of brackets each having a centrally located motor shaft opening with a keying flat aligned one to the other whereby the brackets may be keyed to a flat on the shaft in opposed relation one to the other so the brackets will rotate in unison with the shaft; and said brackets having arms extended radially outward of the motor shaft opening and the opposed ends of the arms supporting opposed ends of pins in bracket pockets on which the rollers are rotatably mounted;

said brackets being of pressed, sintered powdered iron said brackets each having two opposed flats which may be keyed to said flat on the shaft so that a radial dimension discrepancy in the spacing of the bracket pockets may be canceled by changing the hand position of the brackets when mounting them on the shaft.

2. A roller assembly according to claim 1 in which the roller pins are of uniform diameter.

3. A roller assembly according to claim 1 or 2 in which a spring clip is mounted on said shaft for retaining the brackets on the shaft by a rearward thrust against the forwardmost bracket.

4. An assembly according to claim 3 by which the rollers may be replaced with rollers of different diameters by removing the spring retainer and displacing said forwardmost bracket.

* * * * *